United States Patent [19]

Kettlestrings

[11] Patent Number: 4,530,156

[45] Date of Patent: Jul. 23, 1985

[54] INFINITE RADIUS CIRCLE DRAWING INSTRUMENT

[76] Inventor: John S. Kettlestrings, 2235 Stonegate La., Wheaton, Ill. 60187

[21] Appl. No.: 634,150

[22] Filed: Jul. 25, 1984

[51] Int. Cl.[3] ..... B43L 9/04; B44D 3/30

[52] U.S. Cl. ..... 33/27 R; 33/27 L; 33/27 C; 33/562

[58] Field of Search ..... 33/27 R, 174 B, 174 G, 33/27 D, 1 C, 431, 435, 27 C, 27 L, 27 J

[56] References Cited

U.S. PATENT DOCUMENTS

| | | | |
|---|---|---|---|
| 1,154,673 | 9/1915 | Van Ness | 33/27 R |
| 1,307,233 | 6/1919 | Bernard | 33/27 C |
| 2,190,071 | 6/1937 | Keppers | 33/27 R |
| 2,624,117 | 6/1950 | Paci | 33/27 C |
| 3,460,261 | 1/1968 | Frey | 33/27 C |
| 3,465,445 | 9/1969 | Fisher | 33/27 C |
| 3,699,660 | 10/1972 | Siegel | 33/174 B |
| 4,129,948 | 12/1978 | Hatter et al. | 33/27 C |
| 4,353,166 | 10/1982 | Kettlestrings | 33/27 C |
| 4,353,672 | 10/1982 | Smith | 33/174 B |

FOREIGN PATENT DOCUMENTS

| | | | |
|---|---|---|---|
| 733259 | 5/1966 | Canada | 33/27 L |

*Primary Examiner*—Willis Little

*Attorney, Agent, or Firm*—Hill, Van Santen, Steadman & Simpson

[57] ABSTRACT

A device for drawing circles which allows for an infinitely adjustable radius within a given range is provided by the use of a rotatable disk having an access hole therethrough offset from a center point of, but carried on a disk rotatable with respect to a fixed sheet member. The larger disk is freely rotatable and the disk with the access hole is prevented from rotating while the circle is being drawn.

15 Claims, 6 Drawing Figures

INFINITE RADIUS CIRCLE DRAWING INSTRUMENT

BACKGROUND OF THE INVENTION

1. Field of the Invention

This invention relates to an apparatus for drawing circles.

2. Description of the Prior Art

The prior art provides several different types of devices for drawing circles. Most of these devices require a sharp and usually metal point such as a compass tip to act as a pivot to which a pivot arm is connected having a means for marking such as a pencil lead attached to an opposite end of the pivot arm for inscribing a circle. Devices which employ a sharp pointed member may be unsuitable for use by children due to their inherent dangerousness.

Additionally, the sharp point defaces the paper or other surface on which the circles being inscribed by putting a small hole in the surface.

There are other devices in the prior art for drawing circles which do not incorporate any sharp points which are usually sheets of plastic material having various sized holes therein which are lined concentrically with the point about which the circle is to be drawn in the pencil or other writing instrument is abutted against the circumferential wall of the hole and is guided along that wall so as to inscribe a circle on the surface under the plastic sheet. This type of device requires a sheet which is greater in diameter than the circle which is to be drawn, and additionally, if several holes are incorporated in the same sheet, the size of the sheet increases by greater than the diameter of each additional hole.

My prior patent, U.S. Pat. No. 4,353,166 discloses a circle drawing instrument which is compact in form and has no sharp points. The device is comprised of a disk rotatably carried on a sheet adjacent and concentric to a hole in the sheet. The disk and sheet each have a series of holes therein spaced from a center point of the disk into which the tip of a suitable writing instrument may be placed to rotate the disk or sheet with respect to the other, thus inscribing a circle on a desired surface.

In my prior device, the series of holes spaced from the center of the disk which define the radius of the circle to be inscribed are fixed with respect to the center point of the disk and thus only those circles whose radius is defined by one of the predefined holes can be inscribed by this instrument.

SUMMARY OF THE INVENTION

The present invention provides for a device for drawing circles which has no sharp points which could be injurious to the user. The present device comprises an improvement over my prior device in that it provides infinite selection of a radius within the range provided by the device.

The device comprises a sheet carrying a first rotatable disk which has a series of spaced holes therein for inscribing circles of a specific radius. A second rotatable disk is carried on the first rotatable disk, offset from a center point of the first disk, and has at least one hole therein for receiving a circle drawing implement. The second disk is rotatable with respect to the first disk, but only by the application of a relatively large torque force. Such a torque force is not generally generated when a drawing implement is placed in the hole in the second disk while the first disk is rotated relative to the sheet. Grasping means are provided on the second disk to allow the user to selectively change the rotational position of the second disk relative to the first disk in between circles that are being drawn so as to infinitely adjust the spacing of the hole in the second disk from a center point on the first disk.

Other features are provided on the disks including two sets of holes, one set of holes being adapted to receive a standard tapered pencil point and a second set of holes adapted to receive a drafting pen point. Also, some protractor angles are provided as well as an improved means for assembling the first disk to the sheet.

DESCRIPTION OF THE PREFERRED EMBODIMENTS

Figure 1:
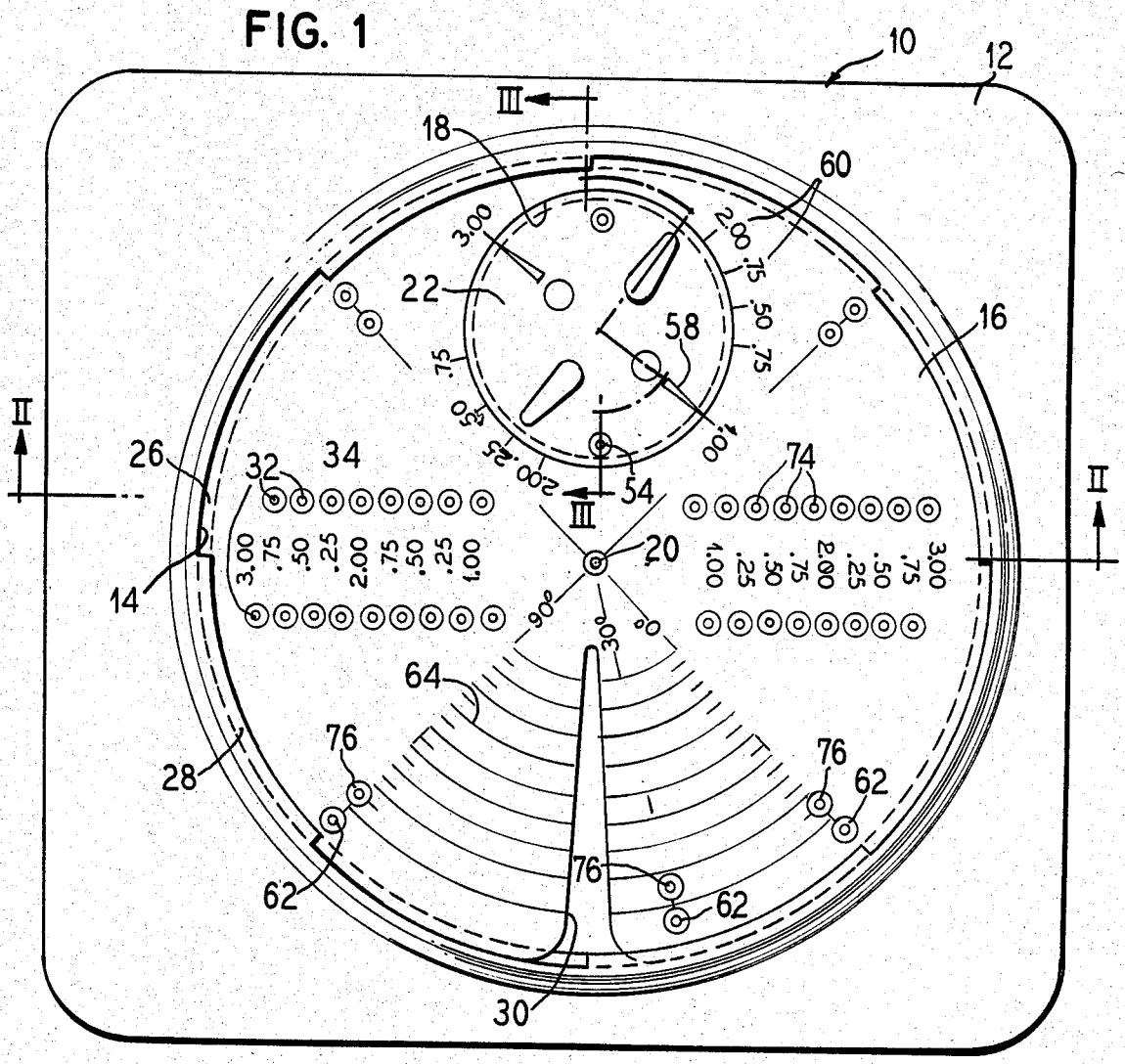
FIG. 1 is a plan view of the circle drawing instrument embodying the present invention.

A device 10 for drawing circles is shown in FIG. 1 as being comprised of a flat plate or sheet 12 having a relatively large central opening 14 therein for receiving a first rotatable disk 16. The first disk 16 has an opening 18 therein offset from a center point 20 of the first disk 16 for receiving a second rotatable disk 22. Although the second disk 22 is shown to be spaced from the center point 20, it is only necessary that the disk 22 be offset from the center point so such that the two disks 16, 22 are not concentric. The plate 12 and the two disks 16, 22 may be fabricated of a plastic material such as acrylic or polycarbonate and in a preferred embodiment are transparent.

Figure 2:
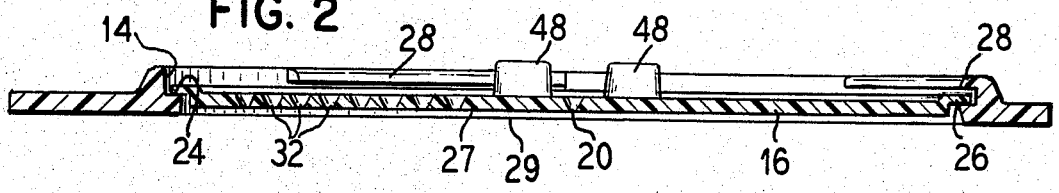
FIG. 2 is a side sectional view taken generally along the lines II—II of FIG. 1.
Figure 3:
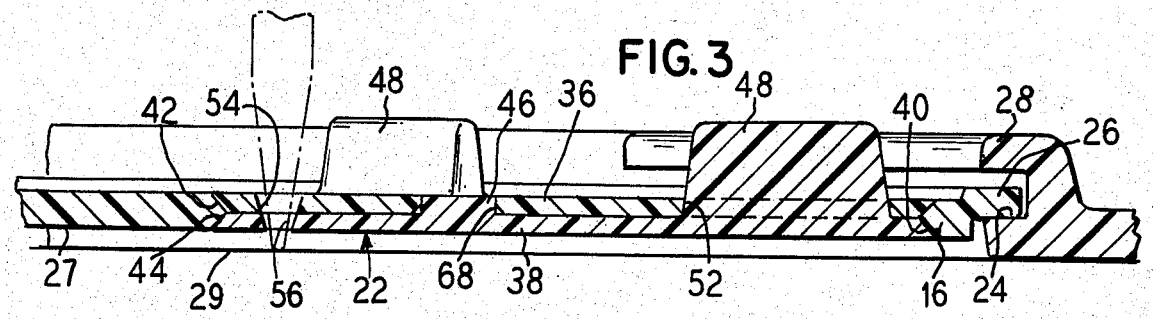
FIG. 3 is a partial side sectional view of the second disk taken generally along the lines III—III of FIG. 1.

As seen in FIGS. 1, 2 and 3, the central opening 14 in the sheet 12 is provided with a lower lip 24 for carrying a circumferential edge 26 of the first disk 16. A series of spaced upper lips 28 are provided around the circumference of the central opening 14 above the circumferential edge 26 to ensure that the first disk 16 is retained within the opening 14. Sufficient clearance is provided between the first disk 16 and the opening 14 and lips 24, 28 to allow the disk 16 to move freely within the opening 14 both circumferentially and vertically. A bottom surface 27 of the disk 16 is spaced above a bottom surface 29 of the sheet 12 to allow the disk 16 to rotate freely above a drawing surface that the sheet 12 is placed on.

A radial slot 30 extending from the circumferential edge 26 of disk 16 to a point short of the center 20 of the disk is provided to assist in the assembly of the disk 16 to the sheet 12. To assemble the disk 16 to the sheet 12, the disk is placed over the opening 14 such that it is laying on top of the upper lips 28. The circumferential edge 26 adjacent the slot 30 is rotated underneath one of the lips 28 as the entire disk is rotated concentric with the opening 14, in effect screwing the disk into the slot or channel defined between the lower lip 24 and upper lip 28. As the disk completes a 360° rotation, the entire circumferential edge 26 will be captured beneath the upper lips 28.

A series of spaced holes 32 are provided at predetermined radial distances from the center point 20 of the disk 16. Indicia markings 34 are provided adjacent the holes 32 so that a user may select a predefined radius for drawing a circle. A writing implement such as a pencil may be inserted into a selected one of these holes with the center point 20 of the disk 16 placed directly over the center point of the desired circle to be drawn. The sheet 12 is then held firmly against the drawing surface while the disk 16 is rotated by the user moving the drawing implement, captured in the hole 32, about the center point 20. In this manner, a circle having a radius defined by one of the provided holes 32 can be drawn.

Figure 4:
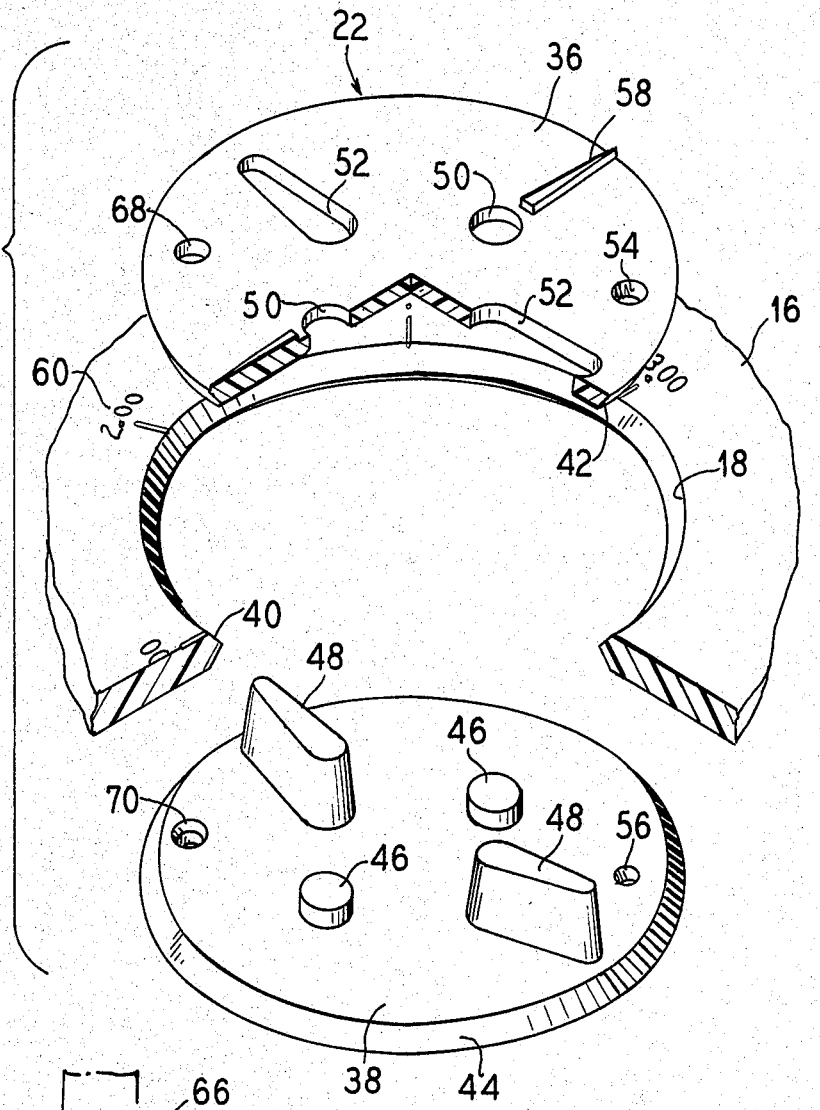
FIG. 4 is an exploded view of the second disk.

To draw a circle having a radius other than the radii of the provided holes, the second disk 22 is to be utilized. As seen better in FIGS. 3 and 4, the second disk 22 is comprised of a top member 36 and a bottom member 38. The two members 36, 38 are substantially identical in size and are adapted to lie one upon the other, sandwiching a double beveled edge 40 of the opening 18 in the first disk 16 between them. The upper member 36 has a beveled circumferential edge 42 designed to mate with the top beveled portion of the beveled opening 40 in the second disk. The bottom member 38 has a beveled circumferential edge 44 designed to mate with the lower beveled portion of the beveled edge 40.

The lower member 38 has a pair of diametrically opposed upstanding posts 46 and a pair of diametrically opposed upstanding knobs 48. The upper member 36 has two diametrically opposed openings 50 designed to frictionally receive the upstanding posts 46. The upper member 36 is also provided with two diametrically opposed openings 52 to frictionally receive the upstanding knobs 48. When the upper member 36 and lower member 38 are assembled together, the frictional fit of the posts 46 and knobs 48 within the openings 50, 52 is sufficient to lock the two members together. If desired, an adhesive may be applied between the two members to permanently lock the two members together.

With the two members 36, 48 locked together, the friction between the beveled edges 42, 44 of the members and the beveled inner edge 40 of opening 18 is sufficient to allow rotation of the second disk 22, but only upon the application of a substantial torque which can be applied to the opposed knobs 48. Such a torque could be applied by manual operation of a user.

At least one opening 54 is provided in the top member 36 which aligns with an opening 56 in the bottom member 38 to receive a drawing implement. A pointer 58 is provided on the upper member 36 and indicia 60 are provided around the circumference of the opening 18 so that the user may select an approximate location for the radius of the circle to be drawn. By rotating the second disk 22 relative to the first disk 16, the opening 54, 56 in the second disk can be moved through an infinite range of radial distances from the center point 20 of the first disk within the range defined by the closest distance of the opening 54, 56 to the center point and the farthest distance. In the embodiment shown in the drawings, the opening 54 can be adjusted within a range of one unit to three units away from the center point 20.

To draw a circle having the desired radius, the writing implement is placed within the hole 54, the sheet 12 is held stationary against the writing surface and the implement is rotated about the center point 20. The torque required to rotate the second disk 22 relative to the first disk 16 is sufficiently large to prevent rotation of the second disk while drawing a circle using hole 54.

Specific angles may also be measured by use of the device embodying the present invention in that there are provided are series of holes 62 at specific marked angular distances. The center point 20 is placed at the vertex of the desired angle and the openings 62 may be used to mark points on the legs of the desired angles. A radial scale 64 is provided to allow measurement of different radii, the slot 30 being positioned within the scale 64 to allow for marking on the drawing surface at any desired point along the scale.

An additional feature of the present invention is that it is adapted to be used by different types of drawing implements, such as a pencil having a tapered point and a drawing pen having a somewhat different configuration.

Figure 5:
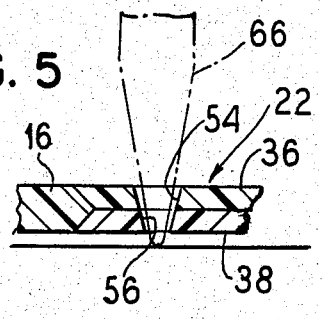
FIG. 5 is a partial sectional view of an opening adapted to receive a tapered pencil point.
Figure 6:
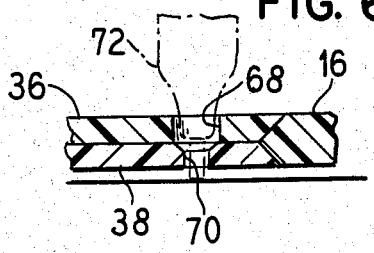
FIG. 6 is a partial side section view of an opening adapted to receive a drafting pen point.

In FIG. 5 there is shown a partial side sectional view of the second disk 22 showing that the opening 54, 56 is shaped to receive the tapered end of a standard pencil 66. In FIG. 6, a second set of holes 68, 70 is provided to receive an inking pen 72 having a profile which is somewhat different than the tapered point of a pencil. As seen in FIG. 1, the first disk 16 has a second set of holes 74 which have a spaced location substantially the same as holes 32, but which are adapted to receive a different writing implement than holes 32. Also, the protractor holes 62 have companion holes 76 which are adapted to receive the different drawing implement.

Thus, it is seen that the present invention provides an instrument for drawing circles both of a predefined radius or of an infinitely selectable radius within the range of the instrument. Different drawing implements may be used with the present invention and various other features including measuring scales, and a means for measuring angles.

As is apparent from the foregoing specification, the invention in susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. A device for drawing circles comprising:

a sheet member for laying on a drawing surface;

a first member rotatably held within an opening in said sheet member, freely rotatable about a center point;

a second member rotatably held within an opening in said first member, offset from said center point;

at least one hole through said second member to accomodate a marking point; and means for restraining said second member against rotation when said marking point is inserted in said hole and rotated about said center point.

2. The device of claim 1 wherein said first member is circular.

3. The device of claim 1 wherein said second member is circular.

4. The device of claim 1 wherein said first member is retained by upper and lower lips formed around said opening.

5. The device of claim 1 wherein said second member is spaced from said center point.

6. The device of claim 1 including manual grasping means to assist in rotating said second member relative to said first member.

7. The device of claim 1 including indicia markings associated with said first and second members identifying the distance between said hole and said center point as said second member is rotated relative to said first member.

8. The device of claim 1 including a plurality of holes in said first member to accomodate said marking point, said holes being spaced from said center point at fixed intervals.

9. The device of claim 1 wherein a plurality of holes are provided in said second member, said holes having varied configurations for accomodating various marking points.

10. A device for drawing circles comprising:

a sheet-form member having a planar lower surface;

a first circular hole formed in said sheet-form member having a given diameter;

a first circular disk having a diameter less than said diameter of said hole and having a marked center point;

means associated with said hole to rotatably retain said disk within said hole such that a bottom surface of said disk is elevated above said lower surface of said sheet-form member;

a second circular hole formed in said circular disk, offset from said center point and having a given diameter;

a second circular disk having a diameter less than said diameter of said second hole;

means associated with said second hole and said second disk to rotatably retain said second disk within said second hole such that a given amount of torque is required to rotate said second disk;

said second disk having at least one hole therethrough to accomodate a marking point;

whereby, rotation of said marking point about said center point will cause rotation of said first disk relative to said sheet-form member and will generate less than said given amount of torque required to rotate said second disk relative to said first disk.

11. The device of claim 10 wherein said second disk is comprised of an upper portion and a lower portion which are sandwiched around a circumferential edge of said second hole.

12. The device of claim 11 wherein said upper portion and said lower portion frictionally lock together.

13. The device of claim 10 wherein said second disk is spaced from said center point.

14. The device of claim 10 including indicia markings associated with said first and second disks identifying the distance between said second disk hole and said center point as said second disk is rotated relative to said first member.

15. A device for drawing circles comprising:

a sheet member for laying on a drawing surface;

said sheet member having a circular hole therein;

a first disk member captured in said hole for free rotation with respect to said sheet member;

said disk member having a circular hole therein offset from a center point of said disk;

a second disk member captured in said second hole for rotation with respect to said first disk member upon the application of a sufficient torque;

said second disk member having at least one hole therethrough for accomodating a drawing point;

whereby rotation of said second disk relative to said first disk provides infinite adjustment of the distance between said second disk hole and said center point, and rotation of said first disk relative to said sheet member causes said second disk hole to define a circle about said center point.

* * * * *